US006129152A

United States Patent [19]

Hosie et al.

[11] Patent Number: 6,129,152

[45] Date of Patent: Oct. 10, 2000

[54] ROTATING BOP AND METHOD

[75] Inventors: David G. Hosie, Sugar Land; Michael B. Grayson, Houston, both of Tex.

[73] Assignee: Alpine Oil Services Inc., Houston, Tex.

[21] Appl. No.: 09/178,328

[22] Filed: Oct. 23, 1998

Related U.S. Application Data

[60] Provisional application No. 60/083,436, Apr. 29, 1998.

[51] Int. Cl.[7] ..... E21B 19/00

[52] U.S. Cl. ..... 166/384; 166/84.1; 166/84.3; 175/195

[58] Field of Search ..... 166/82.1, 83.1, 166/84.1, 84.3, 84.4, 386, 387; 175/195

[56] References Cited

U.S. PATENT DOCUMENTS

| | | | |
|---|---|---|---|
| 1,157,644 | 10/1915 | London . | |
| 3,323,773 | 6/1967 | Walker . | |
| 3,492,007 | 1/1970 | Jones | 166/84.3 X |
| 3,529,835 | 9/1970 | Lewis . | |
| 3,561,723 | 2/1971 | Cugini . | |
| 4,037,890 | 7/1977 | Kurita et al. . | |
| 4,304,310 | 12/1981 | Garrett . | |
| 4,361,185 | 11/1982 | Biffle | 166/84.3 |
| 4,363,357 | 12/1982 | Hunter | 166/84.3 |
| 4,367,798 | 1/1983 | Biffle | 166/84.3 |
| 4,378,849 | 4/1983 | Wilks . | |
| 4,383,577 | 5/1983 | Pruitt . | |
| 4,480,703 | 11/1984 | Garrett . | |
| 4,486,025 | 12/1984 | Johnston . | |
| 4,531,591 | 7/1985 | Johnston . | |
| 4,618,314 | 10/1986 | Hailey . | |
| 4,697,639 | 10/1987 | Caraway et al. . | |
| 4,949,796 | 8/1990 | Williams . | |
| 4,955,436 | 9/1990 | Johnston . | |
| 5,022,472 | 6/1991 | Bailey et al. . | |
| 5,062,479 | 11/1991 | Bailey et al. | 166/84.3 |
| 5,074,518 | 12/1991 | Berry . | |
| 5,101,913 | 4/1992 | Stockley et al. . | |
| 5,178,215 | 1/1993 | Yenulis et al. . | |
| 5,224,557 | 7/1993 | Yenulis et al. . | |
| 5,277,249 | 1/1994 | Yenulis et al. . | |
| 5,279,365 | 1/1994 | Yenulis et al. . | |
| 5,647,444 | 7/1997 | Williams | 175/209 |

*Primary Examiner*—Frank Tsay
*Attorney, Agent, or Firm*—Kenneth L. Nash

[57] ABSTRACT

A rotating blowout preventer and method is disclosed that includes a flexible bladder that defines a pressure chamber radially outwardly of the bladder for direct activation of the bladder to allow for gas tight sealing along the variable profile of drill pipe and the irregular shape of the kelly. The pressure chamber for activating the bladder is preferably defined within the rotating seal assembly. As well, the rotating seal assembly includes both the bladder and the bearings. A pressure drop element is included within the hydraulic flow line through the rotating seal assembly so that the upper seal and bearing have a significantly reduced pressure drop for increased lifetime operation. The rotating seal assembly is hydraulically secured within the rotating blow-out preventer housing, preferably by remote control, by means of a preferred single cylindrical latch piston that moves upwardly and downwardly substantially parallel to the well bore axis. The latch piston wedgeably moves latch dogs radially inwardly to effect latching. After the latch piston is moved from the latch position, the latch dogs move radially outwardly as the rotating seal assembly is lifted from the rotating blow-out preventer housing as by a rig cat line to thereby effect quick change out of the bearings and/or the bladder.

43 Claims, 10 Drawing Sheets

ROTATING BOP AND METHOD

This application claims benefit of U.S. provisional application No. 60/083,436 filed Apr. 29, 1998.

FIELD OF THE INVENTION

The present invention relates generally to rotating blow-out preventers and, more specifically, to a highly flexible rotating bladder and seal assembly remotely latchable within the BOP housing.

BACKGROUND OF THE INVENTION

Underbalanced drilling is advantageous in many circumstances. Underbalanced drilling generally involves the practice of drilling with anticipated downhole pressure greater than hydrostatic pressure of the mud column. Formation pressure is not sufficiently contained or controlled by drilling fluids to prevent flow from the formation. Formation flow could potentially reach the surface to blow out the well if downhole pressure were great enough but for the surface pressure control systems that are used to control well pressure. The rotating blow-out preventer allows the operator to seal around the drill pipe and continue drilling even when the well pressure at the surface is greater than atmospheric pressure.

In horizontal well drilling as compared to vertical well drilling, it may be more difficult to establish well control by hydrostatic fluid head due at least in part to the slower build-up of hydrostatic pressure with well depth (which is not vertical depth) as compared with the build-up that normally occurs rapidly with well depth when drilling vertically oriented wells. The well control problems caused by lack of hydrostatic pressure may be made worse by hole conditions such as abnormal pressures, formation seepage, and lost circulation. In some cases, operators have saved hundreds of thousands of dollars in drilling fluid costs alone by drilling horizontal wells underbalanced. The safety of the operation may also be improved by this method because of the additional pressure control capability of the rotating blow-out preventer used for underbalanced drilling pressure control purposes. While drilling with the rotating blow-out preventer, sudden changes in hole conditions do not result in a dangerous blowout condition that may sometimes not be detected in sufficient time to effectively close in the well. For instance, drilling into a lost circulation zone whereby hydrostatic pressure may be reduced due to fluid loss could result in a sudden loss of pressure control. However, the seal in the rotating blow-out preventer quickly and automatically increases around the drill pipe to account for such sudden changes. In drilling vertical wells, the rotating blow-out preventer may be useful as an additional safety control device because similar fluid loss conditions may also result in well pressure control problems that could be easily handled by use of a rotating blow-out preventer.

Another significant advantage of underbalanced drilling, in either vertical or horizontal wells, is the avoidance of formation damage caused by overbalanced drilling fluids. Repair of formation damage caused by overbalanced drilling may be difficult, time consuming, and limited. Thus, formation damage may significantly reduce a well's ability to produce, thereby significantly affecting profitability of the well.

Another advantage of underbalanced drilling is the result of greatly increased accuracy of logging tools and other measurement devices. Formation invasion by drilling fluid is perhaps the greatest cause of inaccuracies in well logs. For instance, to obtain good measurements of uninvaded formation characteristics, logging tools are expected to compensate for mud cake build-up of the drilling fluid in the borehole, a flushed zone around the borehole wherein all moveable formation fluids have been flushed therefrom, and a partially flushed zone around the borehole wherein moveable formation fluids have been partially flushed therefrom by a not necessarily evenly decreasing percentage until non-invaded formation is reached. It will be understood that compensation techniques, while very useful, cannot always compensate for and accurately determine the characteristics of the non-invaded formation. Therefore, significant zones of oil or gas may remain undetected, or have distorted readings, that cause valuable production zones to be passed over when the operator reviews and selects what may incorrectly appear to be the best producing zones. In the absence of invasion of drilling fluid into the formation due to underbalanced or even near balanced drilling, the accuracy of logging tools is greatly increased because the formation is not invaded and the formation fluids present themselves somewhat more naturally the borehole. This means that the operator has more accurate information with which to make decisions. Other well measurement tools, such as coring tools, will also produce more accurate readings. Thus, there are many advantages to underbalanced drilling.

For underbalanced drilling, the rotating blowout preventer is mounted to the top of a stack of conventional BOP's and can control surface back pressure in a range depending on the rotating blow-out preventer pressure rating. The well is drilled with an underbalanced fluid, such as diesel, water mixed with nitrogen, air, gas, or the like. The rotating blow-out preventer allows rotating and stripping of the drill string during the drilling operation, a significant advantage that normal BOP's do not provide.

Because the rotating blow-out preventer is typically mounted on top of a conventional BOP stack, the length or height of the rotating blow-out preventer is often important depending on the rig set up. Space between the conventional BOP stack and the rotary table and/or drill floor may be strictly limited by the size of the drilling rig and the depth of the cellar to a length required to manipulate the largest drill stands it can drill with. Thus, for general purpose use with many drilling rigs, it is highly desirable for the rotating blow-out preventer to be limited in height. As a result of height restraints, the length of sealing area is limited and must still safely seal variable sized drill pipe, drill pipe connections, and the square or hexagonal kelly, if present for rotary table drilling operations. For purposes of the present application, it assumed that the word tubular defines drill pipes, kellys, and so forth.

The rotating blow-out preventer may use hydraulically activated packing elements mounted for rotation with the drill pipe. If the packing elements are large and heavy, then the bearings may wear more rapidly. Large packing elements and large bearings are quite time consuming to change out, if it becomes necessary to make a replacement. In some rotating blow-out preventer's, the entire top of the rotating blow-out preventer housing must be removed before the bearings can be changed. This may also require removal of the driller's rotary table, which may also be time consuming and may often require a competent rig mechanic to be present.

Large packing elements may not be flexible enough to seal with all drilling elements, such as square or hex-shaped kellys, thereby requiring an additional kelly packing device that adds additional complexity to operation and cost of the Rotating blow-out preventer. Most rotating blow-out preventer's have some provision for changing out at least the most wearable parts of the drill pipe packing elements without the need to remove the rotating drill table. Generally, the packing element, or the most wearable portion thereof, is retrievable through the hole in the drill table. In some designs, this requires fishing to secure the most wearable portion of the packing element. The least wearable portion of a dual element packer may not be available for replacement without extensive time to disassemble the rotating blow-out preventer. Designs for more quickly releasing the packing elements may include removable clamps that have to be manually released, as by a threaded bolt latch, and then manually detached from the rotating blow-out preventer housing. In some designs, hydraulic controls may release the clamp, but the clamp holding the packing elements within the rotating blow-out preventer must then be manually detached from the rotating blow-out preventer housing before the packing elements are removed. Such work with heavy moveable equipment within small enclosures can well be hazardous.

Another problem with presently existing rotating blow-out preventer's is the high failure rate of the upper bearing seal and/or upper bearing. Failure may occur due to the fact that most of the pressure drop between wellbore pressure and ambient pressure is across the upper bearing and seal. The upper and lower bearing seals must seal between a stationary element, such as the rotating blow-out preventer housing, and the rotating elements of the packing assembly. Typically, the pressure drop across the bottom seal and/or bottom bearing is a pressure drop of only about 250 psi or so, because hydraulic activating fluid is typically maintained in the range of from 0 to 500 psi above the well head pressure for activating the packing elements to seal against the drill pipes. However, the upper seal and/or upper bearing must then have the remainder of the pressure drop between the well head pressure and ambient pressure, which pressure depends on the rating of the rotating blow-out preventer and the well head pressure upon which it is used. The large pressure drop across the upper seal and/or bearing places a strain on the upper bearing elements and the upper seal that may cause earlier failure of such bearings. In rotating blow-out preventer systems where bearing change-out is a lengthy process, this is an especially significant problem due to excessive lost rig time caused by such an upper bearing and/or seal failure.

Consequently, an improved rotating blow-out preventer is desirable to provide accurate sealing over a wide range of profile variations in pipe and kellys, quick change-out not only of seals but also of bearings through the rotary table, and provisions to improve the lifetime of especially the upper rotary seals and bearing. Those skilled in the art will appreciate the present invention that addresses these and other problems.

SUMMARY OF THE INVENTION

The present invention relates to a rotating BOP for reliably and conveniently sealing tubulars such as drill pipe that include various profile variations. For purposes herein tubulars also include pipes with square or hexagonal cross-sections, or non-rounded cross-sections, such as the kelly drive often used in rotary drilling.

The present invention and method relate to a highly flexible bladder within an insertable bladder assembly that includes bearings and the bladder, and which is latched into position by built-in hydraulic latch members, such as arc-shaped dogs, and piston actuators that may be remotely operated for releasing the bladder assembly. The bladder may be readily replaced from the removed bladder assembly as it is held in by only two end caps. Preferably a spare bladder assembly is kept available for immediate change out when it is necessary to replace the bladder and/or bearings. The assembly is manufactured at a relatively low cost as compared to some bladder assemblies. The time to change out the bladder assembly may be about 30 minutes or even less once the rig crew becomes familiar with the relatively simple process. The removed and now spare bladder assembly can then be rebuilt at a convenient time without cessation of drilling so that it is ready for subsequent use, if further replacement is required.

Thus, the rotating blow-out preventer of the present invention includes a latch for removably securing a rotating seal assembly, the rotating seal assembly being operable for sealing between down hole pressure and ambient pressure across axially moveable tubulars having profile variations along the length of the tubulars. For purposes of the present application, it is assumed that tubulars can also have different cross-sections than round such as square or hexagonal that correspond to the kelly in an oil rig. A housing is provided in surrounding relationship to the rotating seal assembly and the housing defines a cavity into which the rotating seal assembly is insertable. At least three latch members, and in the presently preferred embodiment six latch members or dogs, are provided with each latch member mounted for radially inwardly and outwardly movement with respect to the rotating seal assembly to latchingly engage and disengage the rotating seal assembly.

A non-rotating portion of the rotating seal assembly is positionable within the housing and the non-rotating portion has a non-rotating latch engagement surface. Each latch member is mounted for radially inwardly and outwardly movement with respect to the rotating seal assembly to latchingly engage and disengage the non-rotating latch engagement surface. In a presently preferred embodiment, the latch members, or dogs, are mounted wholly within the rotating blow-out preventer housing to provide a streamlined profile for the housing.

In a presently preferred embodiment, the latch includes at least one latch piston for actuating the at least one latch. As described hereinafter one latch piston drives six latches but other arrangements are possible. To conserve radial space, the at least one latch piston is mounted for a movement such that a component of the movement is substantially parallel to the borehole axis. In this preferred embodiment, the piston is mounted within the wall of the housing and moves vertically up and down.

In other words, the preferred embodiment includes a plurality of latch members with each latch member having at least a portion thereof that is movable in a straight line toward the rotating seal assembly so as to be latchable therewith. Preferably the straight line movement is directly towards the centerline of the rotating blow-out preventer housing. In the presently preferred embodiment, the latch members move in a straight line rather than in a curved travel path.

Preferably, one or more pistons are available for actuating the one or more latching members or dogs. In the presently preferred embodiment, one piston is used to drive six arc-shaped latches. A wedgeable connection of power transmission between the one or more pistons and the one or more latching members is preferably used as the one or more pistons move vertically and the latch members move substantially radially. The one or more latching members are responsive to wedgeable contact of the wedgeable connection for urging the one or more latching members into latching engagement with the rotating seal assembly. In a preferred embodiment, the piston and latch member make direct wedgeable contact rather than using an intermediary member to form the wedgeable connection.

The rotating blow-out preventer housing is preferably in surrounding relationship to the rotating seal assembly and the rotating blow-out preventer housing preferably adapted to receive fasteners for fastening the housing to the pressure tree assembly so that the housing defines an uppermost portion of the borehole. A connector is preferably provided on the rotating seal assembly, such as a connector for a cat line or the like. The connector is operable for receiving a removal force applied by the cat line to remove the rotating seal assembly from the housing. In a preferred embodiment, remotely controllable latch members are mounted for movement with respect to the housing for latching and unlatching the rotating seal assembly. The rotating seal assembly is removable from the housing by applying the removal force to the connector, as with a cat line, without the need to remove the remotely controllable latch members from the housing, which members are preferably built into the rotating blow-out preventer housing.

In a presently preferred embodiment, a plurality of piston lock members, such as hand-operated levers, are provided for releaseably fastening the one or more, and preferably one, latch piston in the actuating position. Thus, the one or more hydraulic latch pistons may include a ratcheting assembly that allows movement for latching but prevents movement in the opposite direction so that the latch will be maintained even if hydraulic control pressure to the preferably hydraulic one or more latch pistons is momentarily lost. Preferably for simplicity, the plurality of piston latch members are non-remotely operable as with a lever action to engage and disengage a spring-loaded ratchet plate. However, these could also be remotely operable, if desired.

A rotating seal assembly is preferably disposed within the rotating blow-out preventer housing for sealing between down hole pressure of a borehole and ambient pressure across one or more tubulars having profile variations along the length of the one or more tubulars. The tubulars are moveable into and out of the borehole in an axial direction through the rotating seal assembly. The rotating seal assembly preferably includes a tubular frame mounted for rotation with respect to the housing. A substantially hour glass-shaped tubular bladder secured to opposing ends of the tubular frame when the tubular is small or absent. However, the resting shape of tubular bladder depends on the materials available for construction and could easily change if other stronger materials were available for a thinner, more flexible bladder. The present bladder is sufficiently flexible to provide sealing contact with profile variations of the one or more tubulars including round, square, or hex cross-sectional tubulars. A pressure chamber is defined radially outwardly of the tubular bladder. The pressure chamber is adapted for receiving a fluid under pressure for activating the tubular bladder to flexibly conform to the one or more tubulars. In a presently preferred embodiment the tubular frame includes both rotating and non-rotating components and the pressure chamber is defined between the bladder and preferably the non-rotating component of the tubular frame. Conceivably the pressure chamber could be defined at least in part by the housing of the rotating blow-out preventer, which is also non-rotating.

In a presently preferred embodiment, a one-piece tubular bladder is secured to the tubular frame. The one-piece tubular bladder is sufficiently flexible for sealing contact with profile variations of the one or more tubulars, including tubulars with round, square, hexagonal cross-sectional profiles, that may increase and decrease in diameter along the length of the tubular. The pressure chamber is responsive to a fluid receivable into the pressure chamber for activating the one-piece bladder to conform to the one or more tubulars.

First and second end caps are preferably removably securable to the tubular frame for securing the bladder in position. The preferably elastomeric tubular bladder is removably securable to the tubular frame at opposite ends thereof with the first and second end caps. By elastomeric it is meant any pliable material such as polymers, urethane, plastics, and the like, useful for sealing purposes. The presently preferred embodiment uses a urethane material. The end caps are preferably metallic, circular, and have an inner diameter that defines the largest tubulars that may extend through the tubular frame presently positioned within the rotating blow-out preventer housing.

A hydraulic fluid control system is preferably used to circulate hydraulic fluid through the pressure chamber and to maintain a desired seal pressure of the fluid within the pressure chamber which pressure typically is between 0 and 500 psi above the well bore pressure directly below the tubular frame. A wellbore seal is mounted to seal the tubular frame and seals between the seal pressure of the pressure chamber and the well bore pressure. A pressure drop element is provided to produce a significant pressure drop from the seal pressure to a lower pressure much closer to ambient pressure. An ambient seal is mounted to seal the tubular frame between the lower pressure and the ambient pressure.

The bladder preferably has a first portion and a second portion that are axially displaced from each other. The first portion and the second portion each have an inner surface for contacting the tubulars. The first portion being disposed axially adjacent to the down hole pressure and the second portion being axially disposed adjacent to the ambient pressure. The first portion has a smaller radial thickness than the second portion such that the first portion wears more rapidly than the second portion. Therefore a hole in the first portion due to wear would still permit a seal to be maintained by the second portion as the well bore pressure itself would activate the second portion to seal around the tubular prior to closing the BOP to permit change out of the rotating seal assembly.

In operation, the method of removing a bladder assembly from a rotating blow out preventer housing comprises remotely releasing latches that latch the bladder assembly within the rotating blow out preventer housing. A connection to the bladder assembly through a rotary table is made, such as with a cat-line. The bladder assembly is pulled through the rotary table without the need to remove the latches from the rotating blow out preventer housing.

An object of the present invention is to provide an improved rotating blow-out preventer.

Another object of the present invention is to provide a unique bladder that is thin enough to be highly flexible and yet provides inherent backup ability in case of unmonitored wear.

Yet another object is to provide a remotely controllable latch system that permits removal of the rotating seal assembly without removal of the latch from the rotating blow-out preventer housing.

Yet another object of the present invention is to provide a more durable seal and bearing for the rotating seal assembly.

A feature of the present invention is a one-piece bladder.

Another feature of the present invention is a bladder clamped within the seal assembly by two end caps.

Yet another feature of the present invention is a bladder having variations in radial thickness along its axial length so as to provide a more rapidly wearing portion so that the thicker portion can maintain a seal even if a leak should occur in the rapidly wearing portion of the bladder.

Another feature of the present invention is one or more hydraulic latch pistons built within the rotating blow-out preventer housing, although preferably one hydraulic latch piston is used.

Yet another feature of the present invention is that the one or more hydraulic latch pistons are mounted for vertical movement within the rotating blow-out preventer housing, although preferably one vertically moveable cylindrical hydraulic latch piston is used. The cylindrical latch piston preferably encircles the borehole within the wall of the rotating blow-out preventer housing.

An advantage of the present invention is a rotating seal assembly flexible enough to seal with tubulars including tubular joints as well as with square or hex-shaped tubulars such as the commonly used kelly tubular drive elements.

Another advantage of the present invention is a rapid change out time of both the bladder and bearings of the rotating blow-out preventer.

Yet another advantage of the present invention is the ability to remotely release the entire rotating seal assembly for change out.

These and other objects, features, and advantages will become apparent to those skilled in the art upon review of the drawings, claims, and disclosure of the invention.

BRIEF DESCRIPTION OF THE PREFERRED EMBODIMENTS

Figure 1:
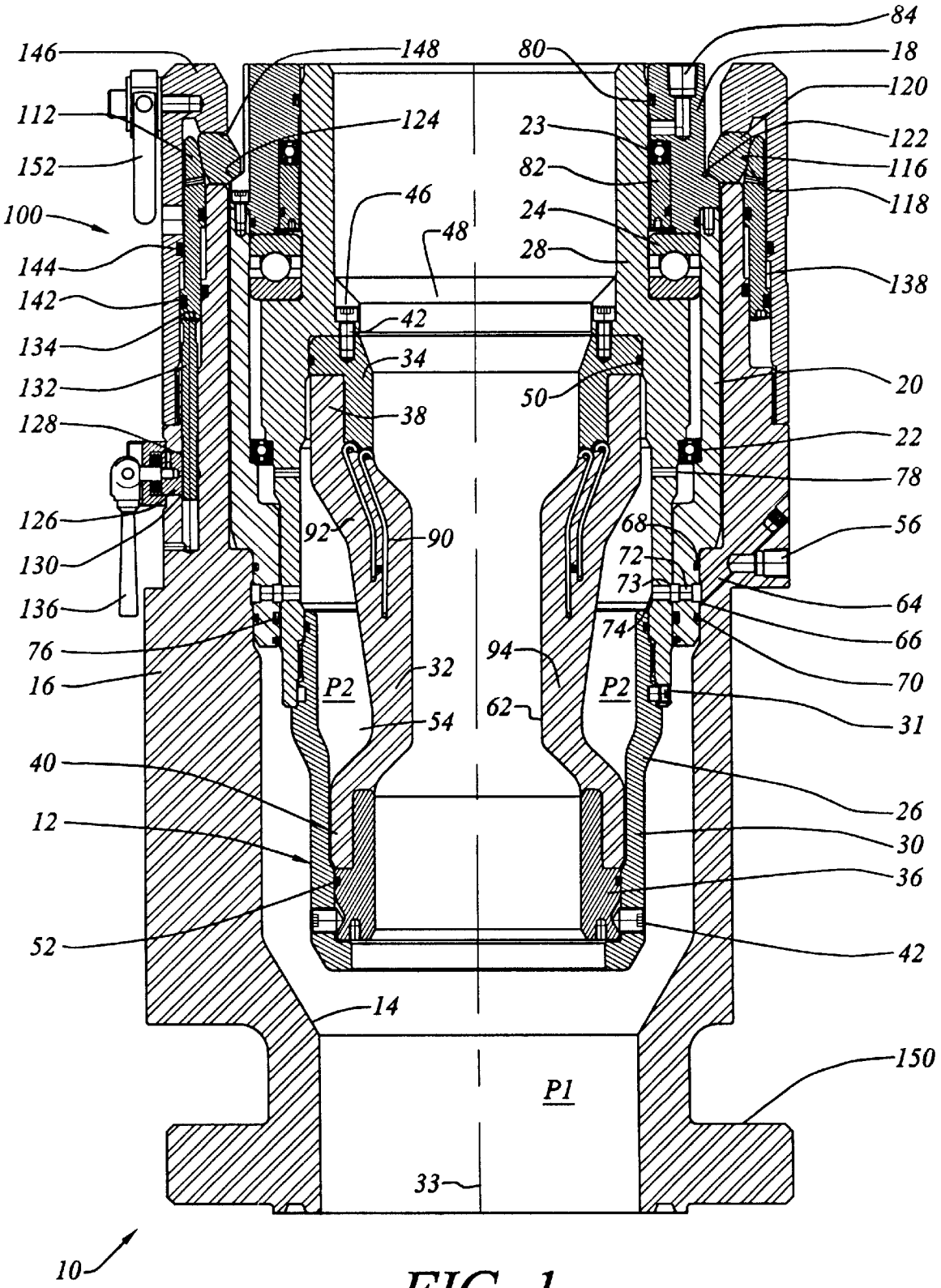
FIG. 1 is an elevational view, in section, of a rotating blowout preventer in accord with the present invention.
Figure 2:
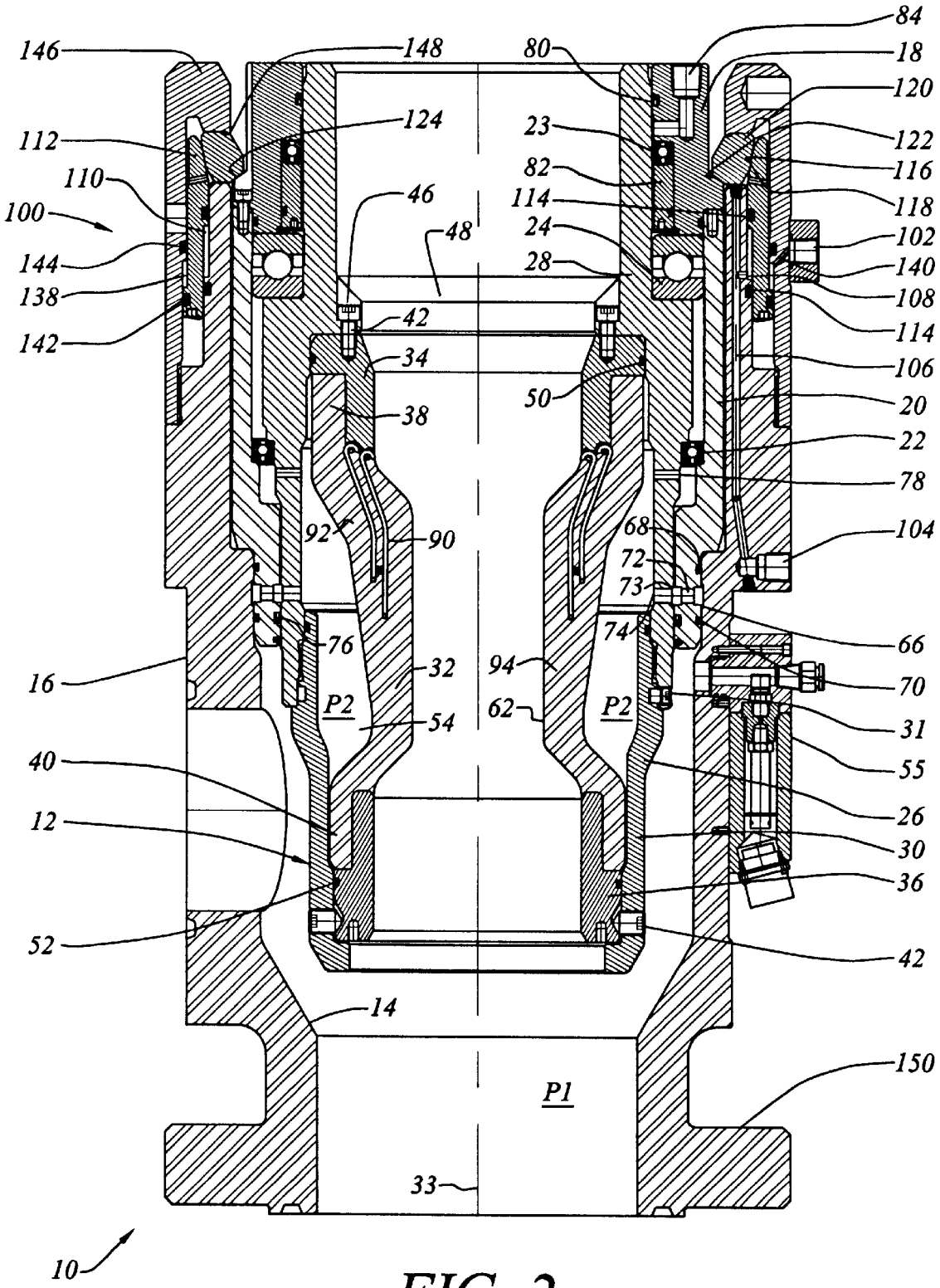
FIG. 2 is an elevational view, in section, of a rotating blowout preventer in accord with the present invention.
Figure 3:
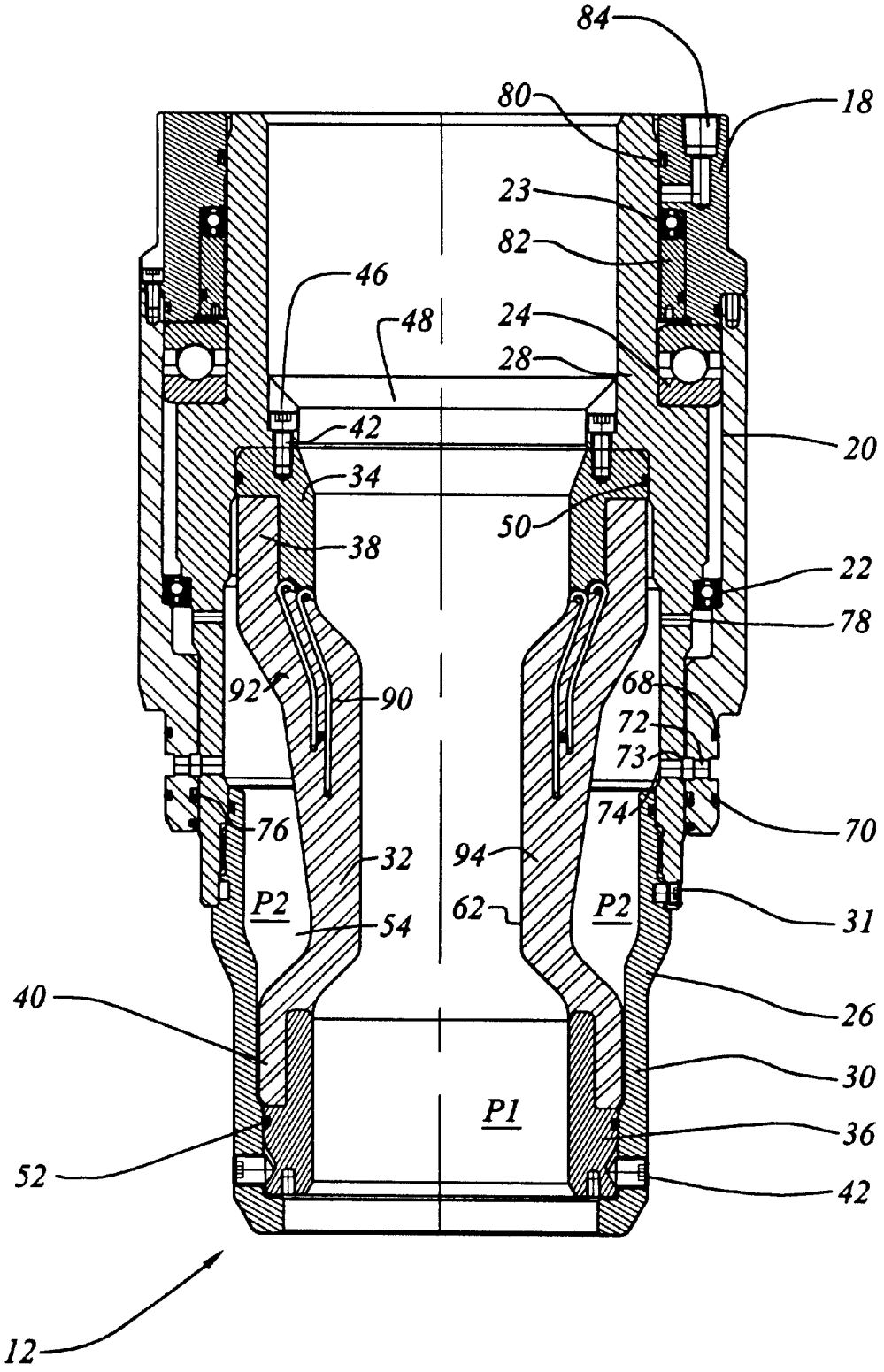
FIG. 3 is an elevational view, in section, of a rotating seal assembly in accord with the present invention.
Figure 4:
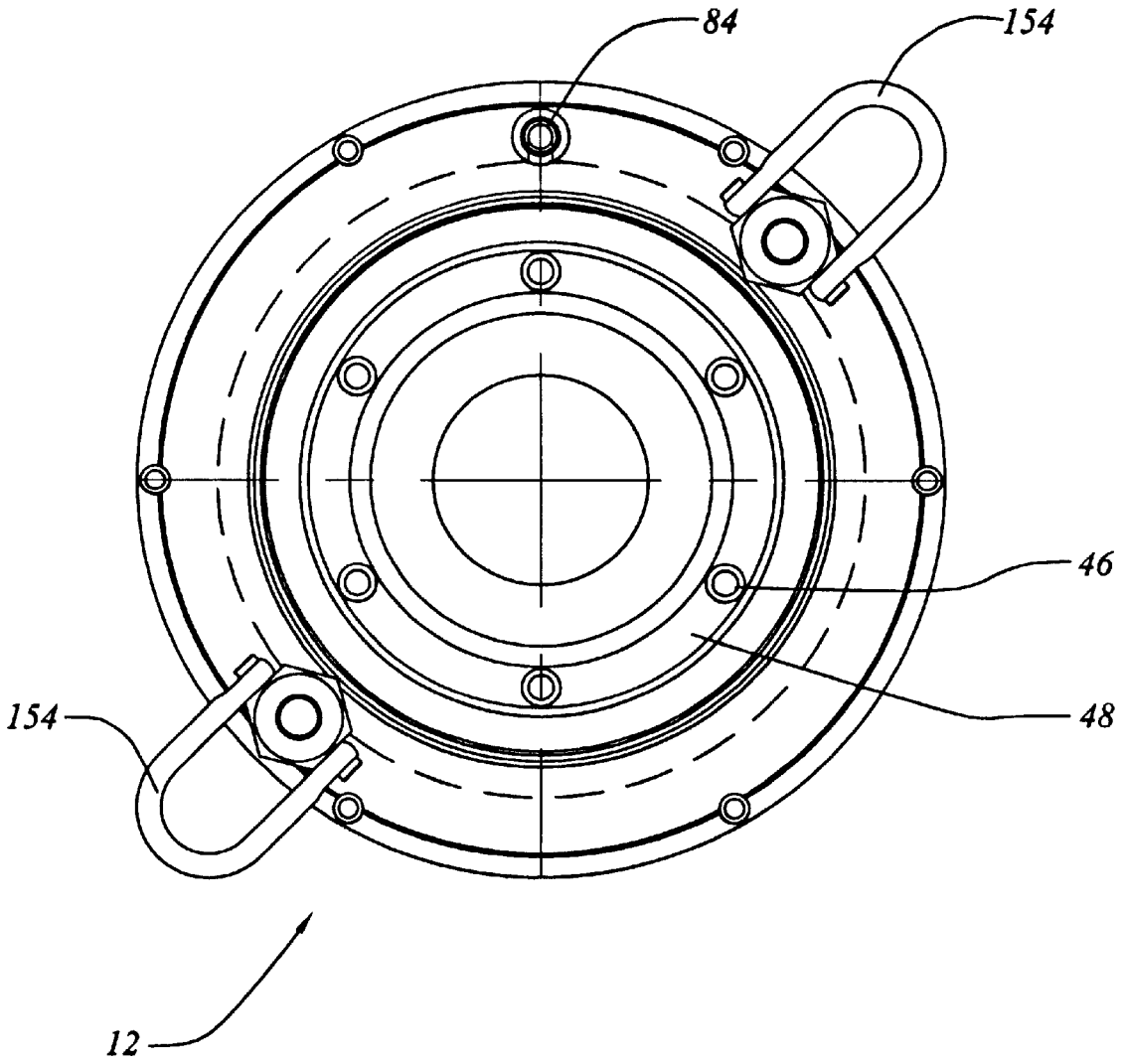
FIG. 4 is a top view of the rotating seal assembly of FIG. 3.
Figure 5:
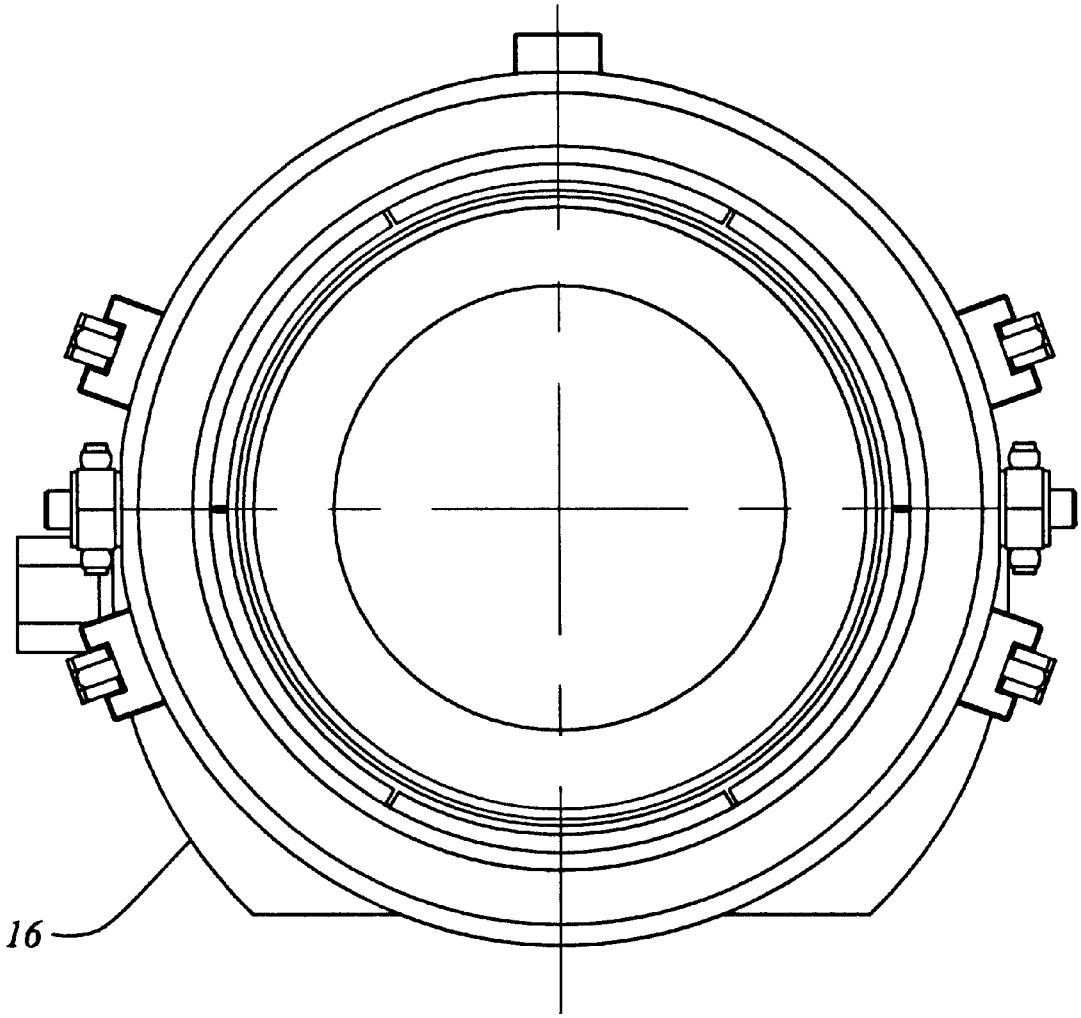
FIG. 5 is a top view of a rotating blowout preventer housing in accord with the present invention.

Referring now to the drawings, and more specifically to FIGS. 1 and 2, there are shown two different sectional views of a rotating blowout preventer 10 in accord with the present invention. Rotating blow-out preventer 10 is comprised of a rotating seal assembly 12 inserted within bore 14 of housing 16. Rotating seal assembly 12 is shown separately from housing 16 in FIG. 3 and FIG. 4. Likewise housing 16 is shown separatelp from rotating seal assembly 12 in FIG. 5–FIG. 8.

Rotating seal assembly 12 preferably includes components that rotate with respect to housing 16 as well as components that do not rotate. Top cap assembly 18 is non-rotating with respect to rotating blow-out preventer housing 16. Bearing housing 20 is also non-rotating. The rotating components of rotating seal assembly are mounted for rotation on radial thrust bearings 22 and 23 and also on axial thrust bearing 24. Bladder support housing 26 includes top mandrel 28 and bottom mandrel 30. Top mandrel 28 and bottom mandrel 30 are preferably threadably secured together and may also preferably utilize a mandrel set screw 31 to prevent any rotating therebetween. Bladder support housing 26 is used to mount bladder 32. Under hydraulic pressure, discussed hereinafter, bladder 32 contracts inwardly to seal around a pipe such as a drilling pipe having relatively large pipe interconnections (not shown) as compared to the long body of the pipe. In fact, bladder 32 can expand to seal off the borehole 33 through rotating seal assembly 12, if desired.

Upper and lower end caps 34 and 36, respectively, fit over upper and lower ends 38 and 40 of bladder 32 to hold it within bladder support housing 26. In this embodiment, lower end cap 36 is held in position with bladder set screw 42 that allows some axial movement of lower end cap 34 and bladder 32. Upper end cap 36 is secured in position by socket head screw 44. Socket head screw 44 is positioned within hole 46 of guide ledge 48 that guides the drill pipe into rotating seal assembly 12. Upper and lower seals 50 and 52 in the respective end caps seal pressure chamber 54 that is presently preferably defined radially outwardly of bladder 32 and radially inwardly of bladder support housing 26. The end caps are made of metal and the maximum size pipe which may extend through rotating seal assembly 12 is limited by the inner diameter of the end caps. The end caps are easily removable to allow easy and quick replacement of bladder 32.

Figure 13:
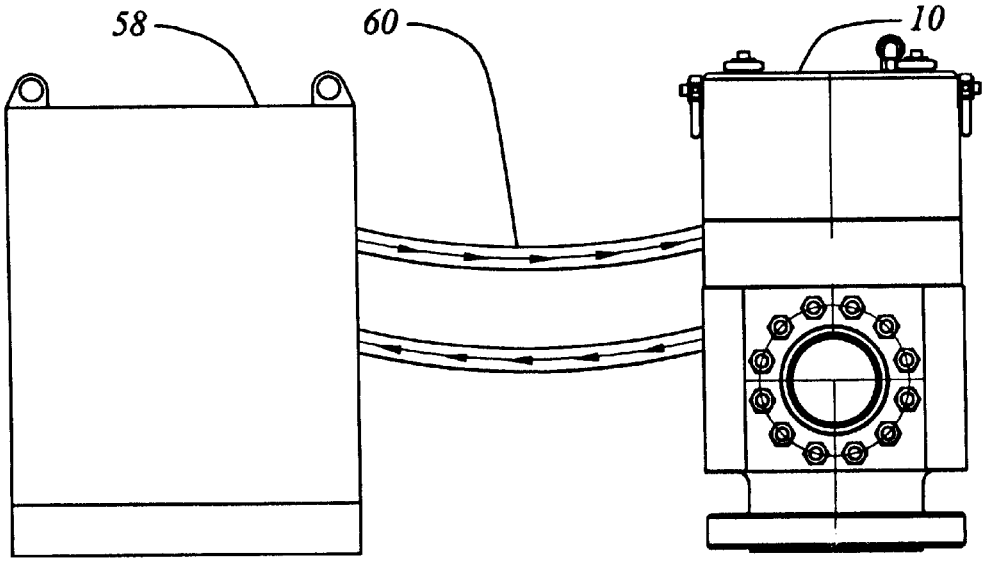
FIG. 13 is a schematic view of a remote hydraulic control system for a rotating blowout preventer in accord with the present invention.

Bladder supply port 56 provides hydraulic fluid under a controlled pressure. The hydraulic fluid supply is indicated schematically as hydraulic control 58, shown in FIG. 13, secured to rotating blow-out preventer 10 by various hydraulic and control lines indicated at 60. The construction details of hydraulic control 58 are not required to understand operation of rotating blow-out preventer 10 of the present invention. Essentially, hydraulic control 58 maintains and monitors hydraulic pressure within pressure chamber 54 and elsewhere. The hydraulic fluid is preferably filtered and cooled for warm weather operation, or heated for cold weather operation. The hydraulic fluid controls bearing temperature and provides bearing lubrication. Pressure transducer 55, shown in FIG. 2, may be used to measure well head pressure. Hydraulic control also preferably operates latching of rotating seal assembly 12 within rotating blow-out preventer housing 16, as discussed hereinafter. Other pressure sensors may also be used to control the pressure chamber 54 and other functions, as discussed hereinafter.

Hydraulic pressure P2 within pressure chamber 54 is preferably maintained by hydraulic control 58 from about 0 to 500 pounds above the well bore pressure at the surface indicated as PI. Thus, if P1 is 1000 psi, then P2 may be about 1250 psi. Bladder 32 is sufficiently flexible that bladder surface 62 is pressed against the pipe at approximately the same pressure P2 to thereby seal off the pipe on which pressure P1 acts. Hydraulic control 58 responds quickly and accurately to maintain the desired pressure differential between pressure chamber 54 at pressure P2 and well bore pressure P1.

Figure 6:
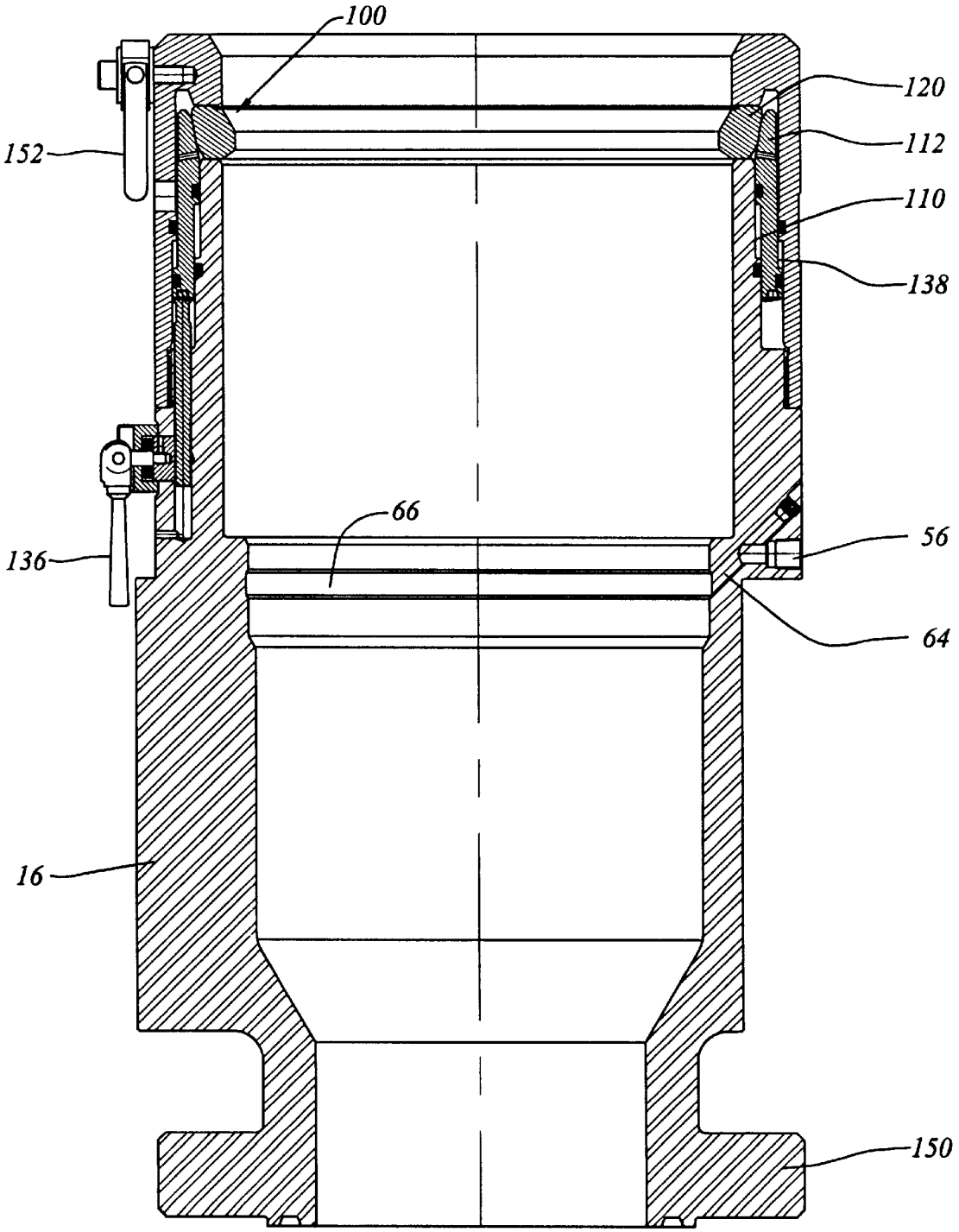
FIG. 6 is an elevational view, in section, of the blowout preventer housing of FIG. 5 along the lines B—B.
Figure 7:
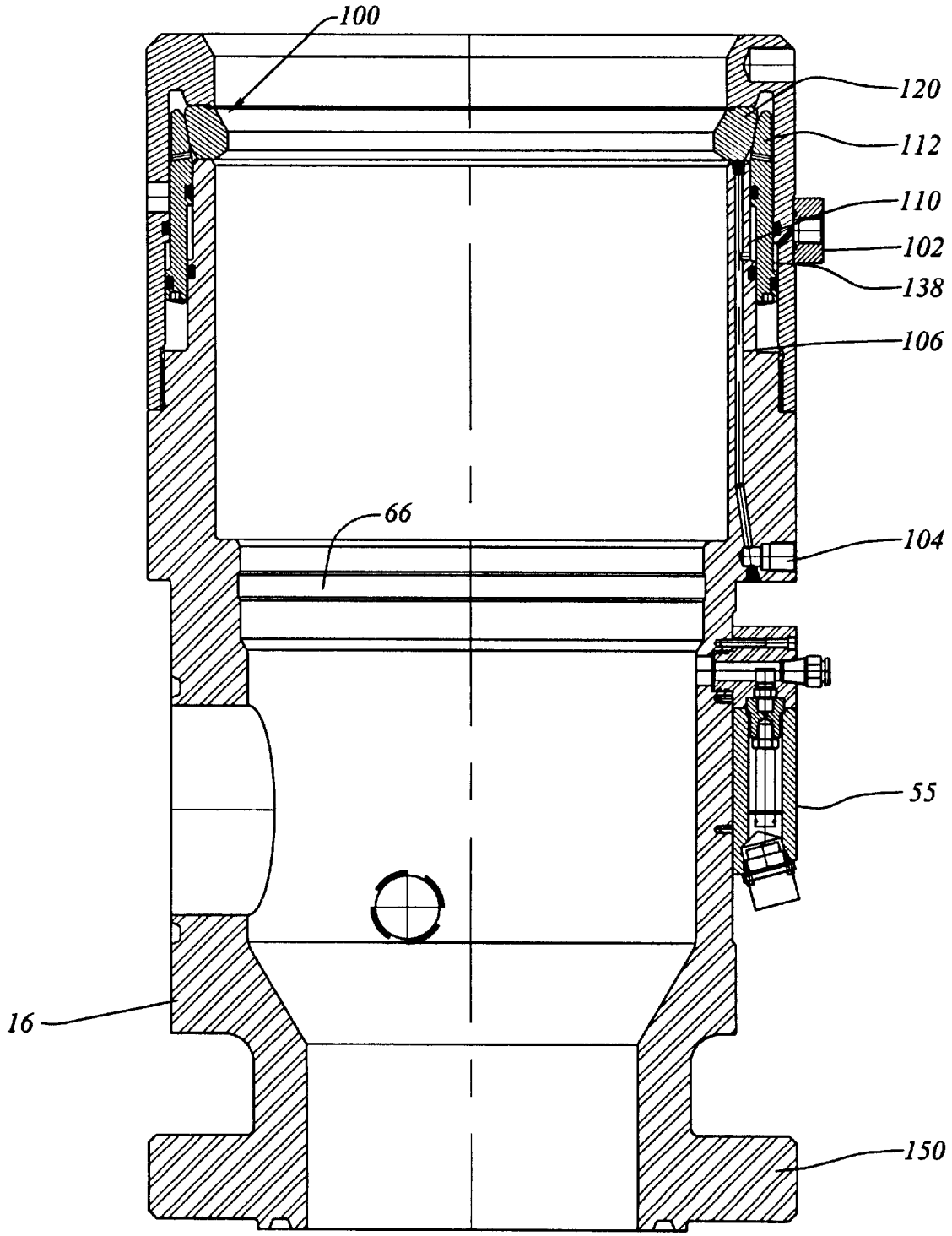
FIG. 7 is an elevational view, in section, of the blowout preventer housing of FIG. 5 along the lines A—A.
Figure 8:
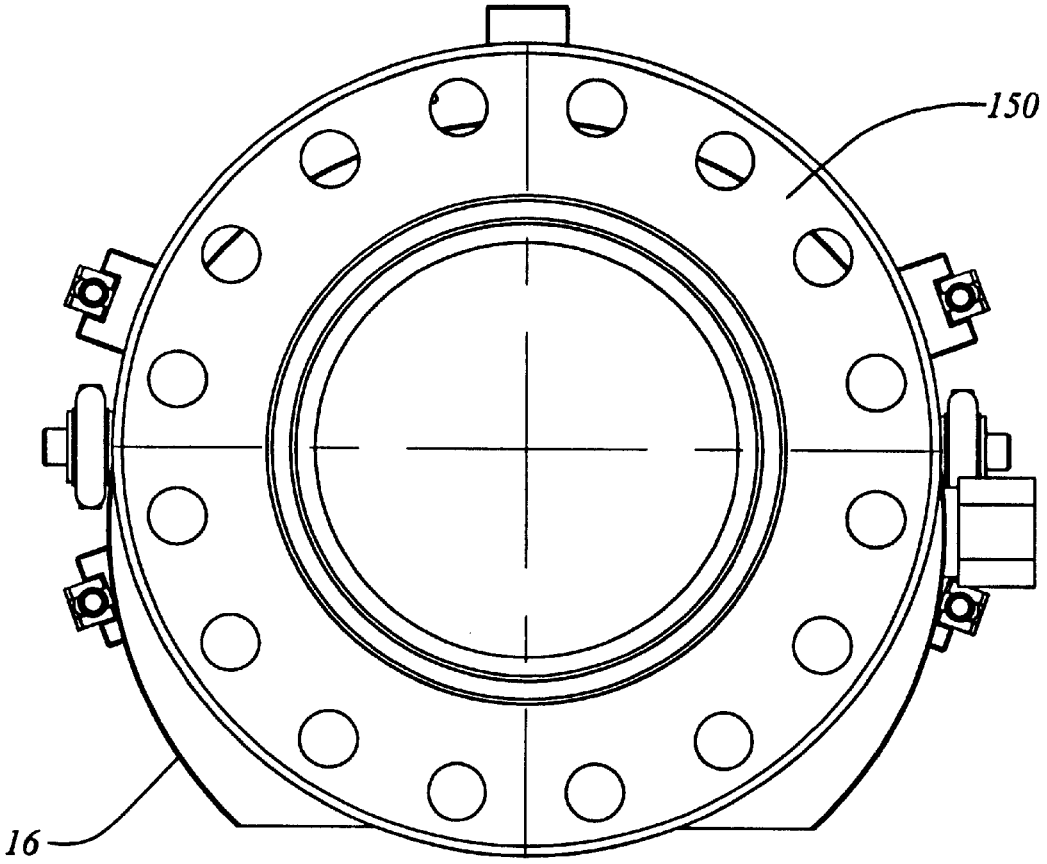
FIG. 8 is a bottom view of the blowout preventer housing of FIG. 5.
Figure 10:
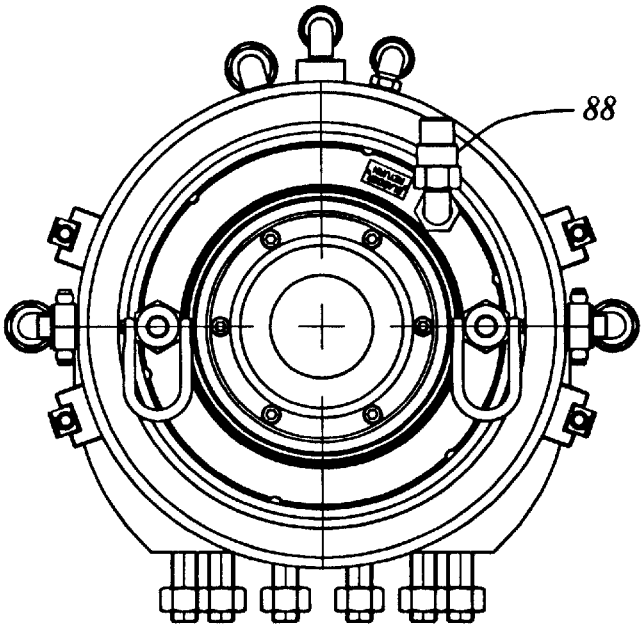
FIG. 10 is a top view of the blowout preventer of FIG. 9.
Figure 9:
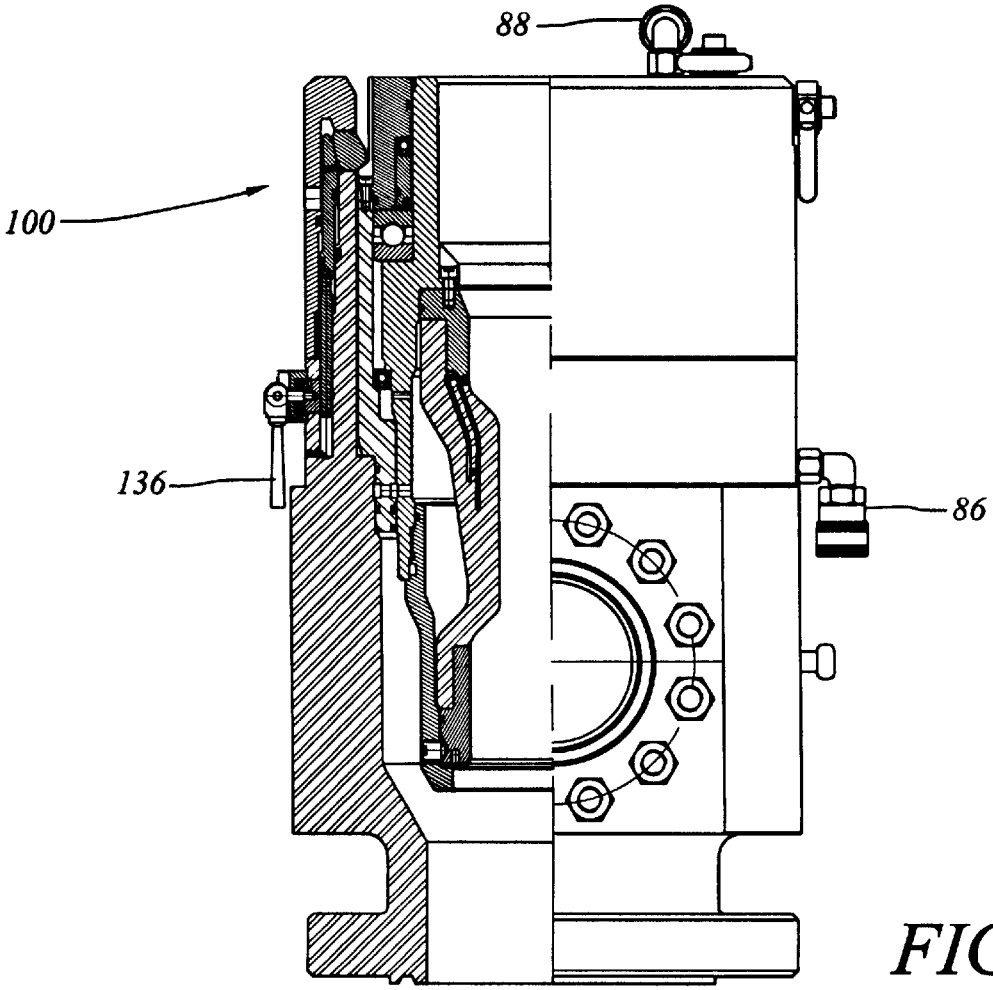
FIG. 9 is an elevational view, partially in section, of a blowout preventer in accord with the present invention.
Figure 11:
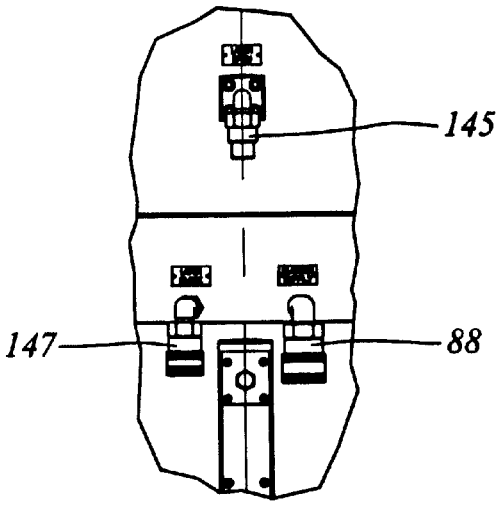
FIG. 11 is an enlarged view of the blowout preventer of FIG. 9 along the lines A'—A'.
Figure 12:
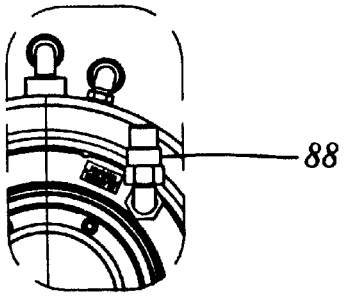
FIG. 12 is an enlarged view of a section from FIG. 10.

Hydraulic fluid flows into port 56, shown in FIG. 1, through flowline or flowlines 64 to recess ring 66 in rotating blow-out preventer housing 16 which may be seen more easily in FIG. 6 and FIG. 7. Seals 68 and 70 above and below recess ring 66 maintain fluid pressure and flow into bearing housing hydraulic ports 72, recess 73, and finally into pressure chamber 54 through upper mandrel port 74. Lower dynamic seal 76 seals the hydraulic flow path with respect to well bore pressure P1 and maintains the seal as top mandrel 28 rotates with respect to bearing housing 20. Therefore, the pressure drop across dynamic seal 76 is fairly small and equal to from about 0 to 500 pounds, the desired pressure differential between P2 and P1 required for sealing the pipe. Hydraulic fluid flows out of pressure chamber 54 through exit port 78 as indicated by the arrows. Fluid flow proceeds through radial thrust bearing 22 and then through axial thrust bearing 24 to provide cooling and lubrication.

At this point the pressure P2 is still approximately equal to about P1 plus a few hundred pounds, which may be a sizeable pressure drop to ambient pressure if the entire drop occurs across bearing 23 and upper dynamic seal 80. A large pressure drop would be likely to cause upper seal 80 and bearing 23 to wear much more quickly than lower dynamic seal 76. Therefore, pressure drop device 82, or a collection of such devices that effectively provide a pressure drop, is used to drop the pressure significantly in the hydraulic flow path before reaching bearing 23 and upper seal 80. The device used herein is a labyrinth ring that limits flow there through and provides a suitable pressure drop by an amount which may be a factor in the range of about ten. However, the actual pressure drop is dependent on many factors such as temperatures, viscosity, and the like. Therefore, a 3000 psi pressure might be reduced to about 300. The pressure drop factor may vary, such as between about five and twenty, depending on the particular pressure drop device or labyrinth selected and the amount of hydraulic flow required. Hydraulic fluid exits through toq cap port 84. Hydraulic connectors such as supply and return connectors 86 and 88 shown in FIG. 9–FIG. 12 provide a hydraulic connection to hydraulic control 58.

Thus, hydraulic pressure within pressure chamber 54 acts to energize bladder 32 for sealing around the drill pipe by providing a force from pressure P2 that is greater than that of P1, as required for positive sealing. Due to the flexibility of bladder 32, it also conveniently seals around irregular shaped drill pipe such as a square or hexagonal kelly. No additional seal member is required for the kelly as in other rotating blow-out preventers'. In the present embodiment, bladder 32 may extend radially inwardly at its center portion to substantially form an hour-glass shape, when no pipe is present. It will move outwardly as larger pipes are placed therein. Actually, the inner bore defined by surface 62 is substantially straight but still is inwardly extending with respect to the end caps. Of course, this shape may vary considerably during drilling operations. As well, this shape may vary due to the material used to form bladder 62. Ideally, bladder 32 would be very strong and quite thin and flexible so that it could then have a straight without the hour-glass shape.

The movement of bottom end cap 36 due to the loose connection 42 allows some additional flexibility for bladder 32 to conform to the pipe for sealing. Support fingers 90 support bladder 32 at the most stressful area of the seal between well head pressure P1 and ambient pressure. Upper region 92 is also much thicker than lower region 94 of bladder 32. An advantage of this is that the thinner lower region 94 will wear through faster than the thicker region. If a hole should form in bladder 32, then it will occur in the lower region. The upper region would then still be held outwardly at the well head pressure and provide a seal until the standard BOP could be closed and the bladder changed out. In reality, this is a very unlikely scenario because hydraulic control 58 would sense any hydraulic leakage long before it wore a hole but this extra safeguard is nonetheless built in. Thinner region 94 also provides increased flexibility for sealing so that the bladder of the present invention can seal over a wide range of drill pipe sizes and at higher pressures. Bladder 32 may be comprised of numerous materials such as elastomeric or polymer based materials. A urethane material is presently used due to limited friction, chemical resistance, and ease of molding. However, other materials may also be suitable.

The entire rotating seal assembly 12 is readily changed out as necessary. Preferably, a spare rotating seal assembly 12 is kept so that the assembly can be immediately replaced for ongoing drilling without taking the time to dress rotating seal assembly. The unique hydraulic latch mechanism 100 provides a quick and remote means for releasing rotating seal assembly 12 from rotating blow-out preventer housing 16. Once manual safety lock levers 136 are released, there is no need for personnel to wrestle with heavy moving components within a small space thereby greatly improving rig safety.

Referring now to FIG. 2, there is shown hydraulic latch release port 102 and latch close port 104. To secure rotating seal assembly 12 within rotating blow-out preventer housing 16, hydraulic fluid is pumped under pressure into close port 104. Hydraulic fluid line 106 carries hydraulic fluid pressure through port 108 into chamber 110. Latch piston 112 reacts to pressure in chamber 110 by moving upwardly. Chamber 110 is sealed with upper and lower seal 114 such as O-rings. Latch piston 112 is tubular and surrounds rotating seal assembly 12. Chamber 110 preferably communicates with the entire latch piston simultaneously. In the presently preferred embodiment, the upper O-ring 114 also encircles latch piston 112. It will be understood that while the present invention uses only one latch piston 112, it would be possible to have a plurality of latch pistons rather than a single latch piston 112, if desired.

Latching is produced as a result of pressure in chamber 110 that is developed by hydraulic control 58. Latch piston 112 moves upwardly in a direction substantially parallel to the center line of bore 33. Latch piston 112 has a wedge surface 116 that engages a wedge surface 118 of dog 120. Dog 120 then moves radially inwardly, so that lock surface 122 of dog 120 engages radially extending sloping surface 124. The sloping surface of 124 and 122 is used, as explained hereinafter, to disengage the dogs for release of rotating seal assembly 12 after the latch piston is moved downwardly. As illustrated in FIG. 2, latch piston 112 is in the locked position so that rotating seal assembly is securely fixed within rotating blow-out preventer housing 16. Furthermore, because the piston moves in a direction parallel to that of the borehole, there are no radially extending pistons that might make the profile of the rotating blow-out preventer irregular if the pistons were oriented to move radially. While disadvantageous to do so with respect to maintaining an economical profile, a plurality of radially movable pistons could also be used to effect movement of the dogs. Dog 120 is similar to a plurality of other dogs. The dogs are each arc-shaped and combine to form a segmented ring with each dog being an arc of the ring. The arc-shaped dogs are driven radially inwardly substantially in a straight line toward the center line. Alternatively, a plurality of smaller dogs for smaller contact areas, driven by a plurality of pistons, could be used for operation but the shown arrangement is considered the preferred arrangement, and is much sturdier.

To ensure that the dogs maintain securely latched even should a hydraulic pressure loss occur, mechanical backup latches 136 as best shown in FIG. 1 are used that operate in ratchet fashion to lock latch piston 112 in a locked position. When engaged, spring loaded ratchet block 126 has ratchet surfaces 128 that engage rod ratchet surfaces 130. Connector rod 132, secured to lock piston 112 at slip connection 134, is permitted by ratchet action to move upwardly with lock piston 112, but is prevented by the ratchet surfaces 128 and 130 from moving downwardly. Moving lever 136 out of the shown lock position into an upward position moves ratchet block 126 radially outwardly to disengage ratchet surfaces 128 and 130 thereby permitting lock piston 112 to move downwardly.

Latch piston 112 is moved downwardly by removing pressure in chamber 110 and then applying a downward force to latch piston 112 by activating pressure in latch release chamber 138. Hydraulic pressure is produced in chamber 138 through latch release port 102 and passage or passages 140 that lead to latch release chamber 138. Like chamber 110, latch release chamber 138 encircles rotating blow-out preventer housing 16 to activate the entire latch piston 112 simultaneously and upper and lower O-rings 144 and 142 seal the chamber. Latch open and latch close hydraulic connectors 145 and 147 shown in FIG. 11 attach to suitable control lines. The lines and connectors are preferably labeled/color coded or otherwise distinguished to simplify connection.

Dog retainer cap 146 contains the latch mechanism components and dogs 120 and is threadably securable to rotating blow-out preventer housing 16. Thus, the chambers and components are readily available for assembly and machining of the chamber is straight forward. The O-rings can be used to hold the latching assembly components together when dog retainer cap 146 is screwed on. It will be noted that lip 148 holds dogs 120 within dog retainer cap 146 by limiting the allowable radial inward movement of dogs 120.

In operation, rotating blow-out preventer housing 16 is normally attached to the top of the BOP stack by means of well head flanges 150. Rotating blow-out preventer housing may typically weigh in the range of about 2000 lbs depending on the size. Lifting eyelets 152 are used to provide a convenient lifting point for the hoist, such as the rig cat line. If not already present, rotating seal assembly 12 may be inserted into rotating blow-out preventer housing 16. The diameter of rotating seal assembly 12 is small enough to fit through the hole in the rotary table. The rotating seal assembly may weigh in the range of about 1800 lbs. Preferably, two rotating seal assemblies are used in operation so that one rotating seal assembly is kept in reserve and may be quickly changed out without the need to dress the assembly. The removed assembly can then be dressed and refurbished at a convenient time.

When installed, handles 136 may be placed in the locked position if they are not already in that position. To latch in rotating seal assembly 12, hydraulic control 58 applies pressure at latch close port 104. Pressure is released from latch open port. The pressure moves latch piston 112 upward and dogs 120 radially inwardly to solidly latch rotating seal assembly 12 into rotating blow-out preventer housing 16. Drilling operations may proceed while hydraulic control 58 maintains the desired pressure differential between well head pressure P1 and pressure chamber 54 pressure P2. This active seal mechanism that energizes bladder 32 provides a gas tight seal at all times. If it should become necessary to change out rotating seal assembly 12, then the standard BOP can be used to provide a static seal on the drill pipe. The well head pressure P1 can be bled off and then pressure P2 in pressure chamber 54 may be bled off. To remove rotating seal assembly 12, release handles 152 are pointed upwardly to allow latch piston 112 to move downwardly at the desired time. Latch pressure at latch close port 104 is then reduced and latch open pressure at port 102 is applied to move latch piston 112 downwardly so as to enable dogs 120 to move radially outwardly. There is no need to have personnel below the rig floor as rotating seal assembly 12 is removed as required with other blow-out rotating preventer's. Rig lines such as cat lines are attached to hoist rings 154, shown in FIG. 4, and lifting force is conveniently applied. Sloping edge 122 on dogs 120 and sloping edge 124 on top cap 18 then wedge dogs radially outwardly as rotating seal assembly 12 is moved upwardly to be easily removed from rotating blow-out preventer housing 16. The spare rotating seal assembly then goes quickly back into place and drilling can continue with very little lost drill time. Thus, one of the big advantages of the present invention is a quick, safe, and easy change out of the rotating seal assembly.

It will now be recognized that a new and improved rotating blowout preventer has been disclosed. Since certain changes and modifications may be made in the disclosed embodiment without departing from the inventive concepts involved, it is the aim of this specification, drawings and appended claims to cover all such changes and modifications falling within the spirit and scope of the present invention.

What is claimed is:

1. A latch for removably securing a rotating seal assembly, said rotating seal assembly being operable for sealing between down hole pressure and ambient pressure across axially moveable tubulars having profile variations along the length of said tubulars, said latch comprising:

a housing defining a housing cavity into which said rotating seal assembly is insertable to provide a surrounding relationship with respect to said rotating seal assembly, said housing having a housing outer wall; and at least three latch members being mounted for radially inwardly and outwardly movement with respect to said rotating seal assembly to latchingly engage and disengage said rotating seal assembly.

2. The latch of claim 1, further comprising:

a non-rotating portion of said rotating seal assembly being positionable within said housing cavity, said non-rotating portion having a non-rotating latch engagement surface, said at least three latch members being mounted for radially inwardly and outwardly movement with respect to said rotating seal assembly to latchingly engage and disengage said non-rotating latch engagement surface.

3. The latch of claim 1, wherein:

said at least three latch members are mounted to be wholly contained internally of said housing outer wall.

4. The latch of claim 1, further comprising:

one hydraulic latch piston for operating said at least three latch members.

5. The latch of claim 4, further comprising:

wedging surfaces for wedgeably interconnecting said one hydraulic latch piston to said at least three latch members.

6. The latch of claim 4, wherein:

said one latch piston is mounted for movement transverse to said radially inwardly and outwardly movement of said at least three latch members.

7. The latch of claim 4, wherein:

said one hydraulic latch piston moves in a first direction to positively operate said at least three latch members for radially inwardly movement, said one hydraulic latch piston moves in a second direction away from said at least three latch members to permit movement of said at least three latch members in a radially outwardly direction.

8. The latch of claim 1, wherein: said at least three latch members each having at least a portion thereof that is moveable in a straight line radially inwardly and radially outwardly.

9. The latch of claim 1, further comprising:

a remote control actuator for remotely controlling said at least three latch members to move radially inwardly.

10. The latch of claim 9, wherein:

force required to move said at least three latch members radially outwardly is supplied by applying upward lifting force to said rotating seal assembly for removal from said cavity.

11. A latch for securing a rotating seal assembly for a borehole, said borehole having a borehole axis therethrough, said rotating seal assembly being operable for sealing between down hole pressure and ambient pressure across one or more tubulars having profile variations along the length of said one or more tubulars, said tubulars being moveable into said borehole, said latch comprising:

a housing in surrounding relationship to said rotating seal assembly;

at least one latch mounted in surrounding relationship to said rotating seal assembly, said at least one latch being mounted for moveable engagement with said rotating seal assembly; and at least one latch piston for actuating said at least one latch, said at least one latch piston being mounted for a movement such that a component of said movement is substantially parallel to said borehole axis.

12. The latch of claim 11, further comprising:

said at least one latch being mounted for movement radially inwardly responsively to movement of said at least one latch piston.

13. The latch of claim 11, further comprising:

a wedgeable connection between said at least one latch and said at least one latch piston to move said at least one latch radially inwardly.

14. The latch of claim 13, further comprising:

said at least one latch piston is mounted so as to be moveable away from at least one latch member to a release position, and said at least one latch member is moveable radially outwardly when said latch piston is in said release position to release said rotating seal assembly in response to an upward removal force acting on said rotating seal assembly.

15. The latch of claim 11, wherein:

said at least one latch piston is mounted within said housing and is remotely operable to allow said latches to latch said rotating seal assembly by remote control.

16. The latch of claim 11, further comprising:

said at least one latch piston being moveable to a latch position for latching said rotating seal assembly, and a lock member for mechanically locking said latch piston in said latch position.

17. A rotating seal assembly disposed within a housing for sealing between down hole pressure of a borehole and ambient pressure across one or more tubulars having profile variations along the length of said one or more tubulars, said one or more tubulars having cross-sectional variations including round, square, and hexagonal cross-sections, said tubulars being moveable into and out of said borehole in an axial direction, said housing defining an aperture therein for receiving said rotating seal and said tubulars, said rotating seal assembly comprising:

a tubular frame mounted for rotation with respect to said housing; and a tubular bladder secured to said tubular frame at opposite ends thereof, said bladder being sufficiently flexible for sealing contact with said profile variations and said cross-sectional variations of said one or more tubulars, a pressure chamber being defined radially outwardly of said tubular bladder, said pressure chamber being adapted for receiving a fluid under pressure for activating said tubular bladder to conform to said one or more tubulars.

18. The rotating seal of claim 17, wherein:

said pressure chamber is defined between said tubular bladder and said tubular frame.

19. The rotating seal of claim 17, wherein:

said tubular bladder is comprised of a single pliable piece.

20. The rotating seal of claim 17, wherein:

said tubular frame forming a portion of a top surface of said housing.

21. The rotating seal of claim 20, further comprising:

latch surfaces on said tubular frame for latching and unlatching of said tubular frame within said housing, said tubular frame being removable from said aperture in said housing when unlatched.

22. The rotating seal of claim 17, further comprising:

first and second longitudinally spaced portions of said tubular bladder, said first portion being disposed further downhole and having a smaller radial thickness than said second portion such that said first portion wears more rapidly than said second portion.

23. A rotating seal assembly disposed within a housing for sealing between a down hole pressure of a borehole and an ambient pressure across one or more tubulars having profile variations along the length of said one or more tubulars, said tubulars being moveable into and out of said borehole in an axial direction, said rotating seal assembly comprising:

a tubular frame receivable into said housing, said tubular frame having at least a portion thereof being mounted for rotation with respect to said housing;

a tubular bladder received in said tubular frame having opposite ends, said tubular bladder being sufficiently flexible for sealing contact with said one or more tubulars and with profile variations of said one or more tubulars, a pressure chamber being defined radially outwardly of said tubular bladder, said pressure chamber being responsive to a fluid receivable within said pressure chamber for activating said tubular bladder to conform to said one or more tubulars; and first and second end caps securable to said tubular frame for holding said opposite ends of said tubular bladder within said tubular frame.

24. The rotating seat of claim 23, wherein:

said pressure chamber is defined between said tubular bladder and said tubular frame.

25. The rotating seal of claim 23, wherein:

said first and second end caps are metallic.

26. The rotating seal of claim 23, wherein:

at least one of said first and second end caps is mounted for limited longitudinal movement.

27. The rotating seal of claim 23, wherein:

said tubular bladder has a single pliable unit construction.

28. A rotating seal assembly disposed within a housing for sealing between a well bore pressure of a borehole and ambient pressure across one or more tubulars having profile variations along the length of said one or more tubulars, said tubulars being moveable into and out of said borehole in an axial direction, said rotating seal assembly comprising:

a tubular frame mounted for rotation with respect to said housing;

a tubular seal element secured to said tubular frame mounted to seal with said one or more tubulars, a pressure chamber being defined radially outwardly of said seal element;

a well bore seal mounted to seal said tubular frame between a seal pressure within said pressure chamber and said well bore pressure;

a pressure drop element to provide a pressure drop from said seal pressure to a lower pressure; and an ambient seal mounted to seal said tubular frame between said lower pressure and said ambient pressure.

29. The rotating seal assembly of claim 28, wherein:

said pressure drop element provides a pressure drop greater than one psi between said seal pressure and said lower pressure.

30. The rotating seal assembly of claim 29, wherein:

said pressure drop element further comprising one or more pressure drop elements, said pressure drop element provides greater a pressure drop greater than one psi.

31. The rotating seal assembly of claim 29, wherein:

said tubular seal element is comprised of a single elastomeric piece.

32. A method of removing a rotating bladder assembly from a rotating blowout preventer housing, comprising:

remotely releasing latches that latch said bladder assembly within said rotating blowout preventer housing;

connecting a lifting cable to said rotating bladder assembly through a rotary table; and pulling said rotating bladder assembly through said rotary table without removing said latches from said rotating blowout preventer housing.

33. The method of claim 32, further comprising:

providing said rotating bladder assembly with bearings.

34. The method of claim 32, further comprising:

providing said rotating bladder assembly with a pressure chamber to produce a seal pressure on a bladder.

35. A latch for securing a rotating seal assembly for a borehole, said borehole having a borehole axis therethrough, said rotating seal assembly being operable for sealing between down hole pressure and ambient pressure across one or more tubulars having profile variations along the length of said one or more tubulars, said tubulars being moveable into said borehole, said latch comprising:

a rotating blow-out preventer housing encircling a housing centerline axis coincident with at least an upper portion of said borehole, said rotating blow-out preventer housing having a housing wall defining a cavity therein for receiving said rotating seal assembly;

at least one latch member mounted to engage said rotating seal assembly to secure said rotating seal assembly within said rotating blow-out preventer housing, said at least one latch member being mounted for movement in a straight line toward said housing centerline axis; and at least one hydraulically controlled piston for actuating said at least one latch member.

36. The latch of claim 35, said at least one latch member further comprises:

a plurality of arc shaped latch members.

37. The latch of claim 35, wherein said at least one latch piston further comprises:

one cylindrical latch piston mounted within said rotating blow-out preventer housing.

38. The latch of claim 37, wherein:

said cylindrical latch piston is mounted within said wall of said rotating blow-out preventer housing.

39. A rotating seal assembly disposed within a housing for sealing between a well bore pressure of a borehole and ambient pressure across one or more tubulars having profile variations along the length of said one or more tubulars, said tubulars being moveable into and out of said borehole in an axial direction, said rotating seal assembly comprising:

a tubular frame mounted for rotation with respect to said housing;

a tubular seal element secured to said tubular frame mounted to seal with said one or more tubulars, a pressure chamber being defined radially outwardly of said tubular seal element; and one or more reinforcement spring members mounted to said tubular seal element.

40. The rotating seal assembly of claim 39, further comprising:

a wall of said tubular seal element, said one or more reinforcement spring members being mounted within said wall.

41. The rotating seal assembly of claim 39, further comprising:

first and second ends for said tubular seal element, said one or more reinforcement spring members being mounted within said first end of said tubular seal element.

42. The rotating seal assembly of claim 39, further comprising:

a pressure drop element to provide a pressure drop from said seal pressure to a lower pressure.

43. The rotating seal assembly of claim 42, further comprising:

an ambient seal mounted to seal said tubular frame between said lower pressure and said ambient pressure.

* * * * *